US008761642B2

(12) United States Patent
Tajiri et al.

(10) Patent No.: US 8,761,642 B2
(45) Date of Patent: Jun. 24, 2014

(54) DEVELOPER SUPPLY APPARATUS HAVING VIBRATING LIGHT TRANSMITTING MEMBERS

(75) Inventors: Tsuyoshi Tajiri, Noda (JP); Toshihide Shima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 190 days.

(21) Appl. No.: 13/399,148

(22) Filed: Feb. 17, 2012

(65) Prior Publication Data

US 2012/0224889 A1 Sep. 6, 2012

(30) Foreign Application Priority Data

Mar. 1, 2011 (JP) ..... 2011-044185

(51) Int. Cl.
*G03G 15/08* (2006.01)

(52) U.S. Cl.
USPC ..... 399/258; 399/261

(58) Field of Classification Search
USPC ..... 399/258, 261
See application file for complete search history.

(56) References Cited

U.S. PATENT DOCUMENTS

| | | | | |
|---|---|---|---|---|
| 4,974,023 | A * | 11/1990 | Aimoto et al. | 399/119 |
| 7,146,115 | B2 | 12/2006 | Suzuki et al. | |
| 8,019,240 | B2 | 9/2011 | Kakuta et al. | |
| 8,224,196 | B2 | 7/2012 | Oh | |
| 2005/0117920 | A1 * | 6/2005 | Ogata et al. | 399/27 |
| 2005/0117922 | A1 | 6/2005 | Suzuki et al. | |
| 2005/0201776 | A1 * | 9/2005 | Askren et al. | 399/106 |
| 2006/0002725 | A1 * | 1/2006 | Ishii | 399/27 |
| 2008/0080877 | A1 * | 4/2008 | Maruyama | 399/27 |
| 2010/0272476 | A1 | 10/2010 | Shima et al. | |
| 2011/0293333 | A1 | 12/2011 | Shima | |

FOREIGN PATENT DOCUMENTS

| | | | | |
|---|---|---|---|---|
| CN | 1619434 | A | 5/2005 | |
| CN | 101231505 | A | 7/2008 | |
| CN | 101592897 | A | 12/2009 | |
| JP | 06202473 | A * | 7/1994 | G03G 15/08 |
| JP | 2002-287477 | A | 10/2002 | |
| JP | 2005-181983 | A | 7/2005 | |
| JP | 2007-114284 | A | 5/2007 | |
| JP | 2010-256758 | A | 11/2010 | |

OTHER PUBLICATIONS

Chinese Office Action dated Aug. 27, 2013, in related Chinese Patent Application No. 201210046398.3 (with English translation).

* cited by examiner

*Primary Examiner* — G. M. Hyder
(74) *Attorney, Agent, or Firm* — Fitzpatrick, Cella, Harper & Scinto

(57) ABSTRACT

A developer supply apparatus includes a buffer portion for storing a developer supplied from a developer container, a feeding device for feeding the developer, stored in the buffer portion, toward a developing device, and a pair of light transmitting members which permit light transmission for detecting the developer in the buffer portion. In addition, a vibrating device vibrates the pair of light transmitting members in an optical axis direction.

11 Claims, 9 Drawing Sheets

(a)

(b)

DEVELOPER SUPPLY APPARATUS HAVING VIBRATING LIGHT TRANSMITTING MEMBERS

FIELD OF THE INVENTION AND RELATED ART

The present invention relates to a developer supply apparatus for supplying to a developing device a developer which is taken out of a developer container and is stored in a storing portion. Specifically, the present invention relates to an optical structure for optically detecting a developer level in the storing portion in order to keep the developer level in the storing portion at a constant level.

In an image forming apparatus for forming a toner image to effect image formation, in order to supply the developer consumed by the image formation, a developer supply apparatus is provided adjacently to the developing device. In the developer supply apparatus, the developer taken out of the developer container is stored in the storing portion (hopper) in a certain amount, and a feeding means is actuated with necessary timing to supply the developer from the storing portion to the developing device.

Japanese Laid-Open Patent Application (JP-A) 2010-256758 discloses a developer supply apparatus in which a toner taken out a toner bottle which is an example of the developer container is stored in a small-volume hopper and then the toner taken out from the bottom of the hopper is scooped up and supplied to the developing device located at a high place by a screw feeding mechanism.

In the developer supply apparatus, there is a need to supply the developer in a proper amount from the developer container with proper timing, thereby to continuously store the developer in the storing portion in a certain amount. This is because a variation in storing amount of the developer supplied to the developing device by a feeding means even when a storing amount of the developer in the storing portion is excessively large or small, so that a quality of an output image is unpreferably influenced.

Therefore, as disclosed in JP-A 2002-287477, a constitution in which a pair of light transmitting members is disposed on a side wall of the storing portion to form an optical path to be light-blocked by the developer stored in the storing portion was proposed. Control of taking-out of the developer from the developer container by evaluating a developer level in the storing portion by transmission/blocking of transmitted light through the light transmitting members was proposed.

However, in this case, resulting from static electricity or humidity, the toner can be deposited on an end surface of the light transmitting members. When the toner is deposited on the end surface of the light transmitting members, the developer is judged as being full even if there is no developer in the starting portion, so that there is a possibility that the developer is not supplied from the developer container. As a result, there is a possibility that a necessary amount of the developer cannot be supplied to the developing device.

For that reason, in JP-A 2002-287477, the light transmitting member end surface is periodically frictionally cleaned from the inside of the storing portion, so that the toner deposited on the end surface is removed.

As described in JP-A 2002-287477, when an exit surface and an incident surface, of detection light, on which the developer is deposited are rubbed with a separate member, the light transmitting member of a transparent resin material having a low hardness, a rubbing damage is caused at a rubbing surface to change a level of the detection light and therefore a detection error of the developer level in the storing portion occurs.

Therefore, as in JP-A 2007-114284, it would be considered that the developer deposited on the light transmitting member is removed by vibrating the light transmitting member but a light quantity to be detected is fluctuated by vibrating the light transmitting member, so that there was a possibility that the developer level was erroneously detected.

SUMMARY OF THE INVENTION

A principal object of the present invention is to provide a developer supply apparatus capable of suppressing a fluctuation of a detected light quantity caused by vibrating a light transmitting member even when a developer deposited on the light transmitting member is effectively removed by vibrating the light transmitting member.

According to an aspect of the present invention, a developer supply apparatus comprises a buffer portion for storing a developer supplied from a developer container; a feeding device for feeding the developer, stored in the buffer portion, toward a developing device; a pair of light transmitting members, which permit light transmission, for detecting the developer in the buffer portion; and a vibrating device for vibrating the pair of light transmitting members in an optical axis direction.

These and other objects, features and advantages of the present invention will become more apparent upon a consideration of the following description of the preferred embodiments of the present invention taken in conjunction with the accompanying drawings.

Figure 9:
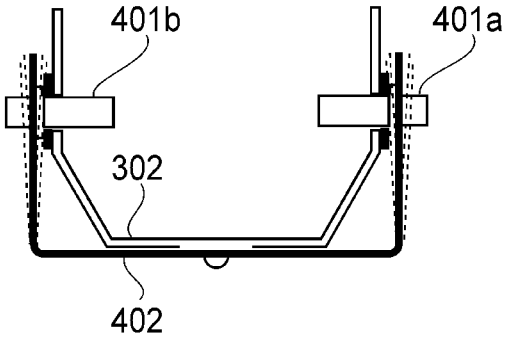
Figure 9:
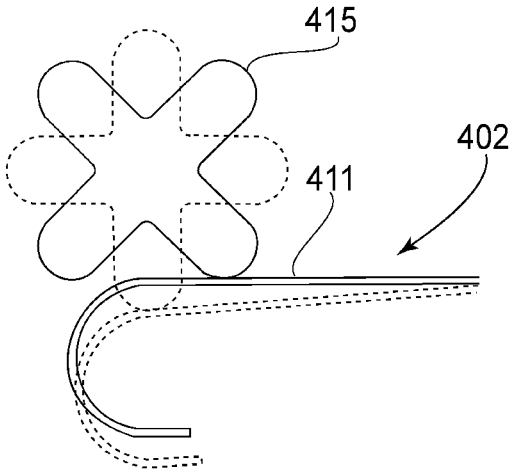

Parts (a) and (b) of FIG. 9 are illustrations of operations of a vibrating generating portion and the vibration transmitting portion, respectively.

DESCRIPTION OF THE PREFERRED EMBODIMENTS

Embodiments of the present invention will be described specifically with reference to the drawings. The present invention can also be carried out in other embodiments in which a part or all of constituent elements are replaced with their alternative constituent elements so long as a light transmitting member for guiding a detection light for a developer level into (or out of) a storing portion is vibrated in order to shake the developer.

Therefore, the present invention is not limited to a developer supply apparatus and a developing device which uses a two-component developer but may also be carried out in the developer supply apparatus and the developing device which use a one-component developer. Further, in this embodiment, only a principal part relating to toner image formation and transfer will be described but the present invention can be carried out by developer supply apparatuses for various purposes such as printers, various printing machines, copying machines, facsimile machines and multi-function machines by adding necessary device, equipment and casing structure.

<Image Forming Apparatus>

Figure 1:
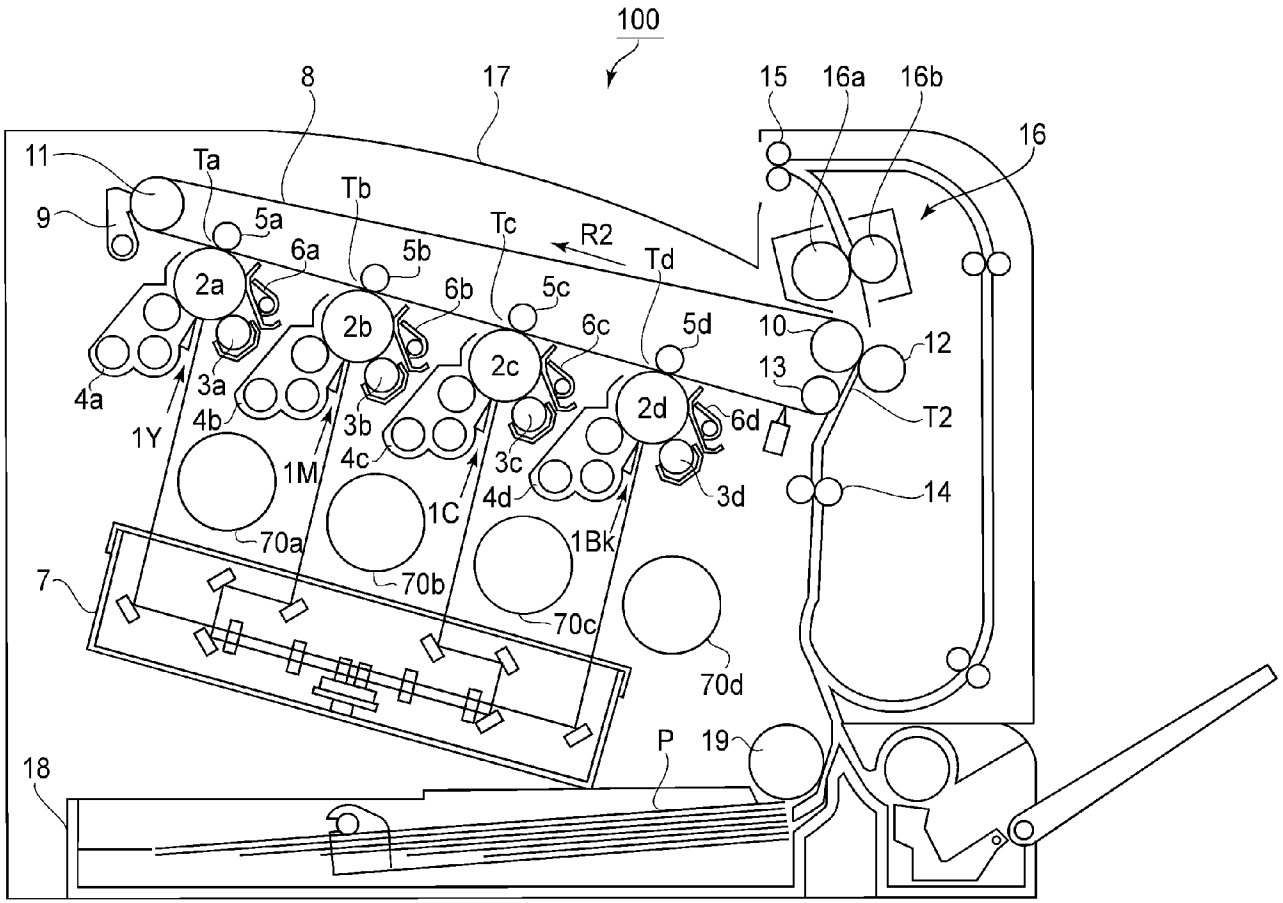
FIG. 1 is an illustration of a structure of an image forming apparatus.

FIG. 1 is an illustration of a structure of the image forming apparatus.

As shown in FIG. 1, the image forming apparatus 100 is a full-color printer of the tandem type and of the intermediary transfer type, in which image forming portions 1Y, 1M, 1C and 1Bk, respectively, are arranged along a downward surface of an intermediary transfer belt 8.

In the image forming portion 1Y, a yellow toner image is formed on a photosensitive drum 2*a*, and is transferred onto the intermediary transfer belt 8. In the image forming portion 1M, a magenta toner image is formed on a photosensitive drum 2*b*, and is transferred onto the intermediary transfer belt 8. In the image forming portions 1C and 1Bk, cyan and black toner images are formed on photosensitive drums 2*c* and 2*d*, respectively, and are transferred onto the intermediary transfer belt 8. After being primary-transferred onto the intermediary transfer belt 8, the four toner images are conveyed to a second transfer portion T2 and then are collectively secondary-transferred onto a recording material P.

The recording material P on which the four toner images are secondary-transferred is conveyed to a fixing device 16, in which the recording material P is subjected to heat and pressure, whereby the toner images are fixed on its surface and thereafter the recording material P is discharged onto an upper portion tray 17 through a discharging roller 15.

A separation roller 19 separates the recording material P pulled out from a recording material cassette 18 one by one and sends the separated recording material P to a registration roller 14. The registration roller 14 receives the recording material P in a rest state to place the recording material P in a stand-by state and then sends the recording material P to the secondary transfer portion T2 by being timed to the toner images on the intermediary transfer belt 8.

The fixing device 16 forms a heating nip by causing a pressing roller 16*b* to press-contact a fixing roller 16*a* provided with a heater. The recording material P is subjected to heating and pressing in the heating nip to melt the toner images, so that a full-color image is fixed on the surface thereof.

The image forming portions 1Y, 1M, 1C and 1Bk have the same constitution except that the colors of the developers used by their developing apparatuses 4*a*, 4*b*, 4*c* and 4*d* are different from each other as yellow, magenta, cyan and black. In the following, the image forming portion 1Y will be described, and other image forming portions 1M, 1C and 1Bk will be described by replacing the suffix "a" of reference numerals or symbols of constituent members of the image forming portion 1Y with b, c and d, respectively, of those thereof.

The image forming portion 1Y includes a charging roller 3*a*, an exposure device 7, a developing device 4*a*, a primary transfer roller 5*a*, and a cleaning device 6*a*, which are disposed at the periphery of the photosensitive drum 12*a*.

The photosensitive drum 2*a* is prepared by forming a photosensitive layer having a negative charge polarity on an outer peripheral surface of an aluminum cylinder and a driving force is transmitted from an unshown driving motor to the photosensitive drum 2*a*, so that the photosensitive drum 2*a* is rotated at a predetermined process speed.

The charging roller 3*a* is rotated by the rotation of the photosensitive drum 2*a* and is supplied with an oscillating voltage in the form of a negative DC voltage biased with an AC voltage, so that the surface of the photosensitive drum 2*a* is charged to a uniform negative potential.

The exposure device 7 effects scanning exposure with a laser beam, through a rotating mirror, obtained by ON-OFF modulation of scanning image data developed from a yellow separated color image, so that the electrostatic image for the image is written (formed) on the charged photosensitive drum 2*a*. The developing device 4*a* develops the electrostatic image into a toner image by transferring the toner onto the photosensitive drum 2*a*.

The primary transfer roller 5*a* urges the intermediary transfer belt 8 to form a primary transfer portion Ta between the photosensitive drum 2*a* and the intermediary transfer belt 8. By applying a positive DC voltage to the primary transfer roller 5*a*, the negative toner image carried on the photosensitive drum 2*a* is primary-transferred onto the intermediary transfer belt 8 passing through the primary transfer portion Ta.

The cleaning device 6*a* slides a cleaning blade on the surface of the photosensitive drum 2*a* to remove transfer residual toner deposited on the surface of the photosensitive drum 2*a* passing through the primary transfer portion Ta.

The intermediary transfer belt 8 is extended around and supported by a tension roller 11, a driving roller 10 which also functions as a secondary transfer opposite roller, and a stretching roller 13, and is driven by the driving roller 10 to be rotated in an arrow R2 direction.

The secondary transfer portion T2 is constituted by bringing the secondary transfer roller 12 into contact with the intermediary transfer belt 8 stretched by the driving roller 10 at an inner surface. By applying the positive DC voltage to the secondary transfer roller 12, a transfer electric field for the toner image is formed between the secondary transfer roller 12 and the driving roller 10 which is connected to the ground potential.

A belt cleaning device 9 slides a cleaning blade on the surface of the intermediary transfer belt 8 to remove the transfer residual toner deposited on the surface of the intermediary transfer belt 8 passing through the secondary transfer portion T2.

Below the developing devices 4*a*, 4*b*, 4*c* and 4*d*, toner bottles 70*a*, 70*b*, 70*c* and 70*d* are disposed, respectively. With respect to the toners consumed in the developing devices 4*a*, 4*b*, 4*c* and 4*d*, toners are supplied from the toner bottles 70*a*, 70*b*, 70*c* and 70*d*, respectively.

<Developing Device>

Figure 2:
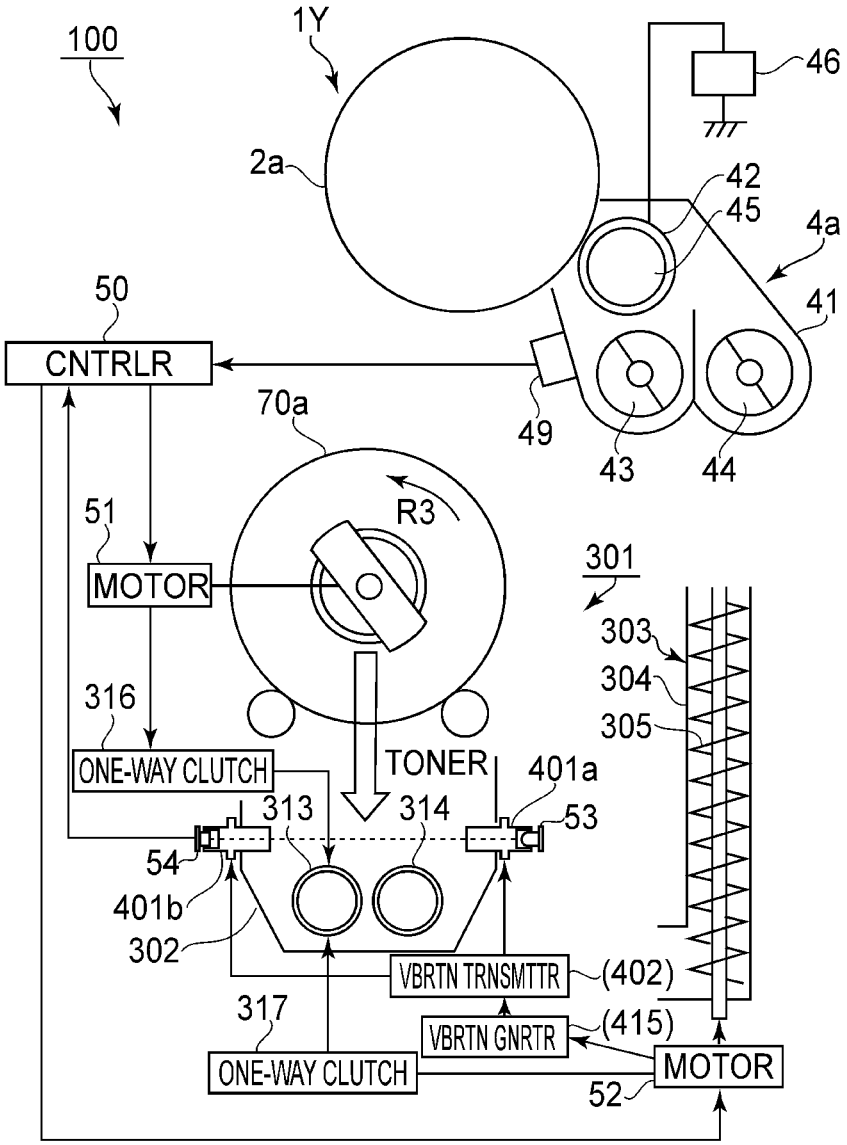
FIG. 2 is an illustration of a structure of each of a developing device and a developer supply apparatus.

FIG. 2 is an illustration of a structure of each of the developing device and the developer supply apparatus. As shown in FIG. 2, the developing device 4*a* charges the developer stored in a developing container (storing portion) 41 to carry the developer on a developing sleeve 42, thus developing the electrostatic image on the photosensitive drum 2*a*. In the developing container 41, a two-component developer consisting of the toner (non-magnetic) and a carrier (magnetic) is filled. The developer is fed is in opposite directions by a developing screw 43 and a stirring screw 44 which are provided in the developing container 41, thus being triboelectrically charged in a circulating process in the developing container 41.

Inside the developing sleeve 42, a magnetic roller 45 is provided in a non-rotational state, and a magnetic force of the magnet roller 45 magnetically constrains the carrier, thus carrying the developer on the surface of the developing sleeve 42. A power source 46 applies to the developing sleeve 42 an oscillating voltage in the form of a DC voltage biased with an AC voltage, so that the toner in the developer is transferred onto the photosensitive drum 2*a*.

In two-component development which improves the image quality and is an inexpensive running cost, there is a need to keep a ratio between a carrier amount and a toner amount in the developing device 4*a* at a constant value. For that reason, by adjusting the toner supplied to the developing device 4*a*, the ratio between the carrier amount and the toner amount in the developing device 4*a* is kept at the constant value.

With the image formation, only the toner is transferred from the developer onto the photosensitive drum 2*a* and is consumed and therefore a controller 50 controls a toner supply apparatus 301 every image formation so that the toner in an amount corresponding to the amount of the toner consumed by the preceding image formation on the one-sheet old recording material is supplied to the developing device 4*a*. Further, when the toner is supplied every image formation, an error is accumulated, so that there is a possibility that a toner content (a weight ratio of the toner to the developer) of the developer in the developing container 41 is deviated from a proper range. For that reason, the controller 50 controls the toner supply apparatus 301 on the basis of an output of a toner content sensor (permeability sensor) 47 so that the toner content in the developing container 41 is kept at 8-10%.

<Developer Supply Apparatus>

Figure 3:
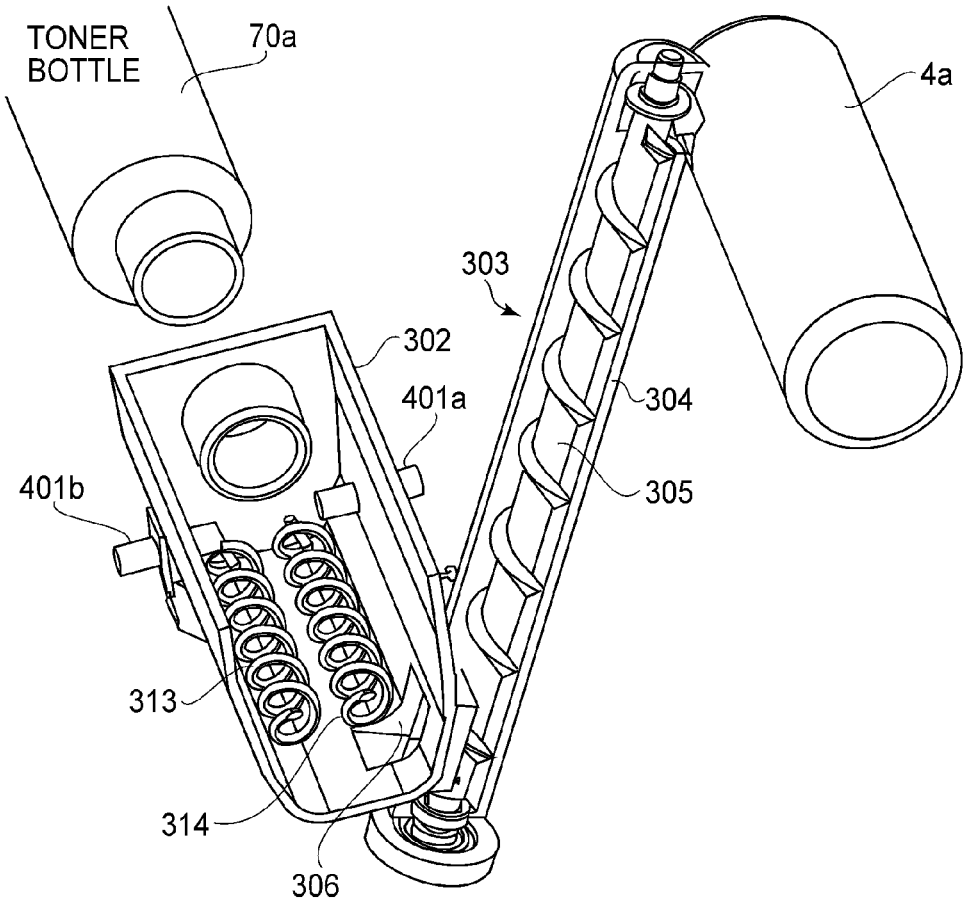
FIG. 3 is a perspective view of the toner supply apparatus.
Figure 4:
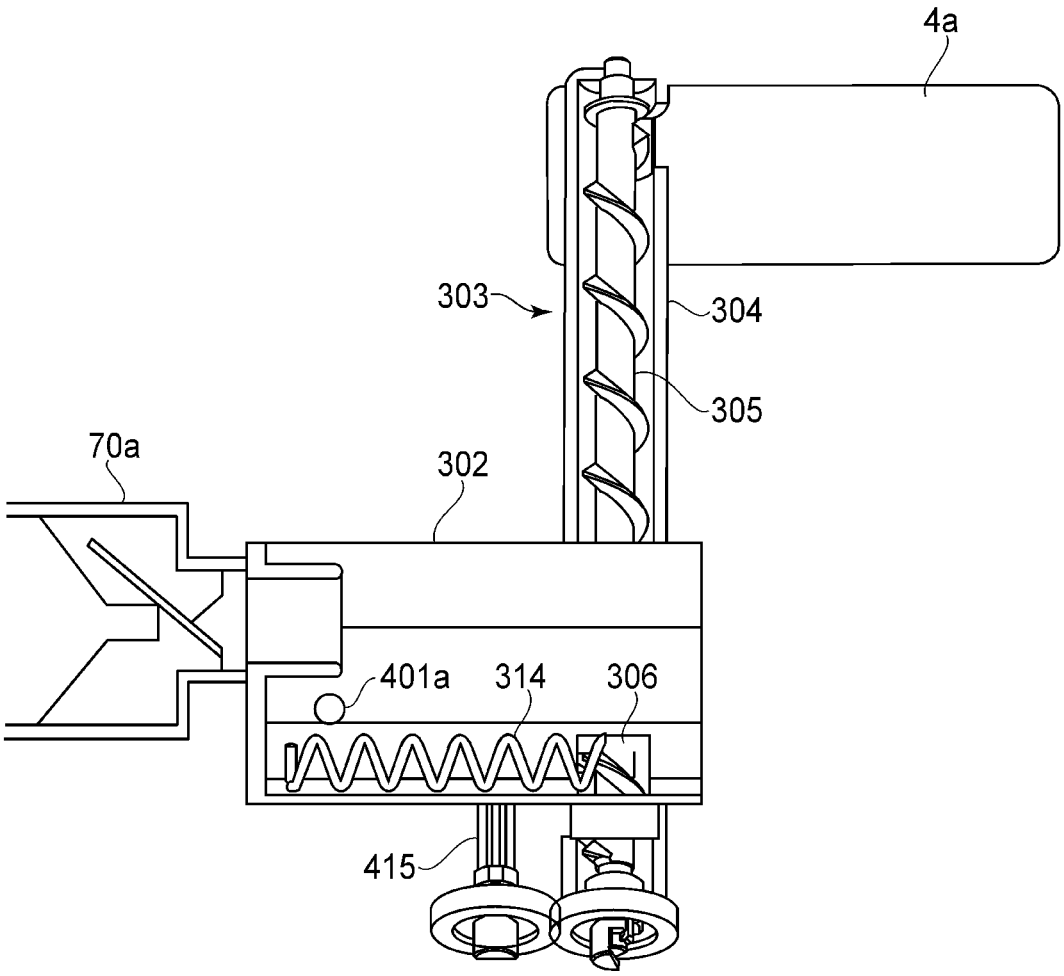
FIG. 4 is a sectional view of the toner supply apparatus as seen from a side surface.

FIG. 3 is a perspective view of the toner supply apparatus. FIG. 4 is a sectional view of the toner supply apparatus as seen from a side surface.

As shown in FIG. 3, a toner storing portion 301 which is an example of the storing portion stores the developer supplied from the toner bottle 70*a* which is an example of the developer container. A toner feeding portion 303 which is an example of feeding means feeds the developer, stored in the toner storing portion 302 which is an example of the storing portion, toward the developing device 4*a*.

That is, the toner supply apparatus 301 scoops up the toner which is taken out of the toner bottle 70*a* and is stored in the toner storing portion 302 which is an example of a buffer portion, and then supplies the toner to the developing device 4*a* in a controlled supply amount. The toner feeding portion 303 includes a pipe 304 provided with openings corresponding to the developing device 4*a* and the toner storing portion 302 and includes in the pipe 303 a screw 405 for feeding the toner. In order to adjust the supply amount of the toner feeding portion 303, it is essential that the inside of the pipe 304 is always filled with the toner.

The toner feeding portion 303 supplies the toner from the toner storing portion 302 storing the toner to the developing device 4*a*. In the toner storing portion 302, the toner supplied from the toner bottle 70*a* is dropped and accumulated by gravitation and then is taken out by the toner feeding portion 303 from a discharge opening 306 provided at a lower portion of the toner feeding portion 303, thus being supplied to the developing device 4*a*.

As shown in FIG. 4, in order to precisely control the amount of the toner supplied to the developing device 4*a*, depending on a rotational angle of the screw 305, there is a need to supply the toner with a stable "bulk density" to the developing device 4*a*. Further, in order to supply the toner with the stable bulk density to the developing device 4*a*, in a state in which the bulk density of the toner in the neighborhood of the discharge opening 306 is stabilized, there is a need to stably and continuously feed the toner from the toner storing portion 302 to the screw 305. For that reason, the toner supply apparatus 301 stirs the toner, stored in the toner storing portion 302, with coil screws 313 and 314 to enhance flowability, so that the toner surface in the toner storing portion 302 is kept in a flattened state.

As shown in FIG. 2, the controller 50 which is an example of a control means detects the light transmitting through light transmitting members 401*a* and 401*b* and controls the developer supply from the toner bottle 70*a*. Opposing side walls of the toner storing portion 302 are provided with the pair of light transmitting members 401*a* and 401*b* which form an optical path in the toner storing portion 302. The light transmitting members 401*a* and 401*b* have end surfaces located inside the toner storing portion 302, so that the optical path to be light-blocked by the developer stored in the toner storing portion 302.

In order to realize stable toner supply by the toner feeding portion 303, there is a need to always store the toner in a constant amount in the toner storing portion 302. For that reason, the controller 50 detects the toner amount in the toner storing portion 302 depending on light transmission/light blocking of the optical path in the toner storing portion 302 and then supplies the toner from the toner bottle 70*a* to the toner storing portion 302 depending on a detection result.

The controller 50 detects a toner level in the toner storing portion 302 by using detection light (infrared light) guided into the optical path in the toner storing portion 302. In order to detect a remaining amount of the toner accommodated in the toner storing portion 302, the detection light generated by a light emitting diode 53 provided outside the toner storing portion 302 is guided into the inside of the toner storing portion 302 through the light transmitting member 401*a*. Then, the detection light is guided to the outside of the toner storing portion 302 through another light transmitting member 401*b* to enter a light receiving element 54.

The toner bottle 70*a* is rotatably supported and in the toner bottle 70*a*, an inclined partition wall for permitting the discharge of the toner from the inside of the bottle with the rotation is assembled. By actuating a motor 51 to rotate the toner bottle 70*a*, the toner T in the toner bottle 70*a* is discharged into the toner storing portion 302.

The side walls of the toner storing portion 302 are provided with the light transmitting members 401*a* and 401*b* which use a rod-like lens of an acrylic resin material. The infrared light outputted from the light emitting diode 53 emitted via the light transmitting member 401*a* enters the toner storing portion 302 and then enters the light receiving element 54 via the light transmitting member 401*b*.

The controller 50 adjusts the amount of the toner taken out from the toner bottle 70*a* in order to keep the toner surface in the toner storing portion 302 at a constant level. The controller 50 judges, in the case where the light is blocked by the toner in the toner storing portion 302 and thus is not detected by the light receiving element 54, that there is the toner and does not rotate the toner bottle 70*a*.

However, when the light from the light emitting diode 53 is detected by the light receiving element 54, the controller 50 judges that there is no toner and starts the rotation of the toner bottle 70*a*. When the optical path between the light transmitting members 401*a* and 401*b* is blocked by the toner surface, the rotation of the toner bottle 70*a* is stopped.

The controller 50 rotates the toner bottle 70*a* until the detection light from the light emitting diode 53 is not detected by being blocked by the toner surface, thus replenishing a fresh toner into the toner storing portion 302 to increase the toner surface in the toner storing portion 302.

The controller rotationally drives the screw 305 by actuating the motor 52, thus scooping up the toner in the toner storing portion 302 to the developing device 4*a*. In the developing device 4*a*, the fresh toner is, after being taken out from the toner bottle 70*a* and then being temporarily stored in the toner storing portion 302, supplied in a necessary amount by the screw 305.

Comparative Embodiment

Figure 5:
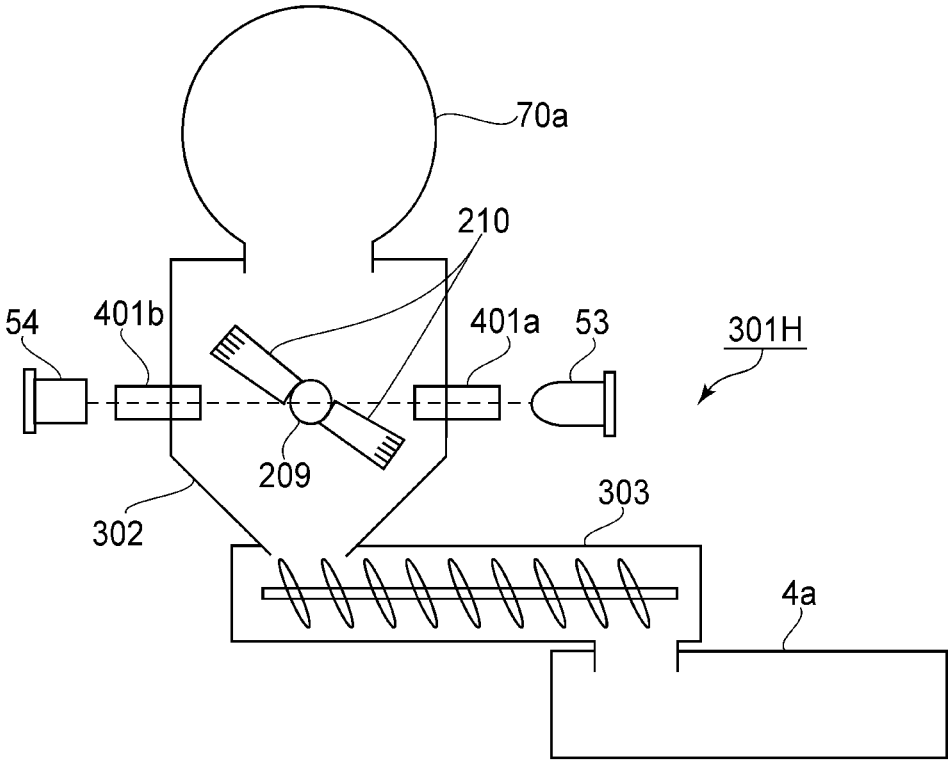
FIG. 5 is an illustration of a toner supply apparatus in a Comparative Embodiment.

FIG. 5 is an illustration of a toner supply apparatus in a Comparative Embodiment. As shown in FIG. 5, a toner supply apparatus 301H in the Comparative Embodiment judges the presence or absence of the toner depending on whether or not the optical path between the light transmitting members 401*a* and 401*b* is blocked by the toner surface in the toner storing portion 302. In this case, the end surfaces of the light transmitting members 401*a* and 401*b* where the detection light enters and goes out permit passing of the detection light and therefore there is a need to prevent the deposition of the toner at the end surfaces.

For this reason, in the toner supply apparatus 301H in the Comparative Embodiment, a part of a toner stirring member 209 which stirs the toner at the inside of the toner storing portion 302 is provided with cleaning members 210. The cleaning members 210 are constituted by an elastic member (nylon brush) and rotate in synchronism with the rotation of the toner stirring member 209, so that the end surfaces of the light transmitting members 401*a* and 401*b* are rubbed with ends of the cleaning members 210 and thus the toner is removed.

However, in the toner supply apparatus 301H in the Comparative Embodiment, when the remaining toner amount is detected, the toner stirring member 209 is rotated to scatter the toner, so that the toner is deposited on the end surfaces of the light transmitting members 401*a* and 401*b*. When improper scraping by the cleaning members 210 occurs, detection accuracy of the remaining toner amount is lowered. By the rubbing (sliding) between the end surfaces of the light transmitting members and the cleaning members 210, a minute toner agglomeration occurs and when the toner agglomeration is fed to the developing device 4*a*, there is a possibility that image quality lowering is invited.

Further, when the toner deposited on the end surfaces is scraped off by the cleaning members 210, the cleaning members slide on the end surfaces of the light transmitting members 401*a* and 401*b*, whereby frictional damage is caused at the end surfaces. When abrasion (wearing) at the end surfaces progresses, the detection light causes diffused reflection and thus detection accuracy thereof is lowered. When the abrasion of the cleaning members 210 progresses, the improper scraping due to deterioration is generated, so that a durable lifetime of the light transmitting members 401*a* and 401*b* is shortened.

Therefore, in the following embodiments, without providing the cleaning members 210, the toner deposited on the end surfaces is shaken off by vibrating the light transmitting members 401*a* and 401*b*.

Embodiment 1

Figure 6:
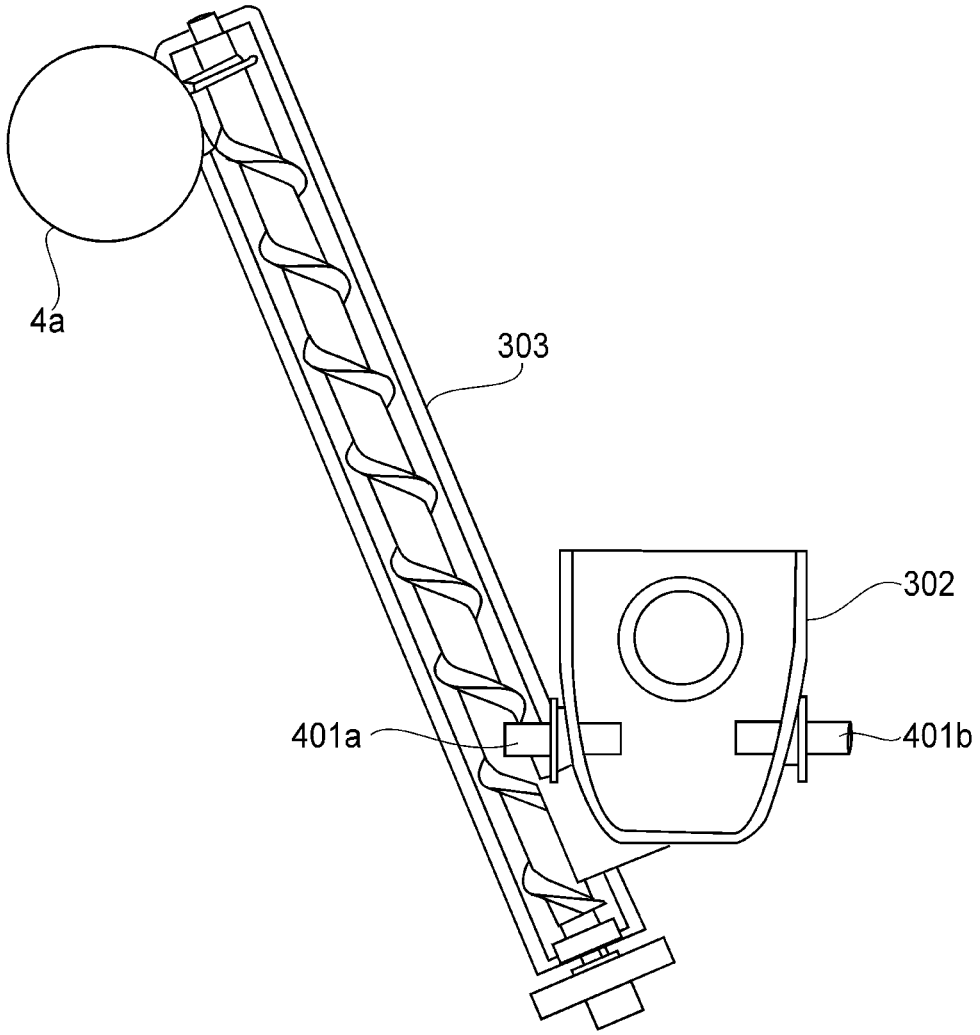
FIG. 6 is an illustration of an arrangement of a light transmitting member.
Figure 7:
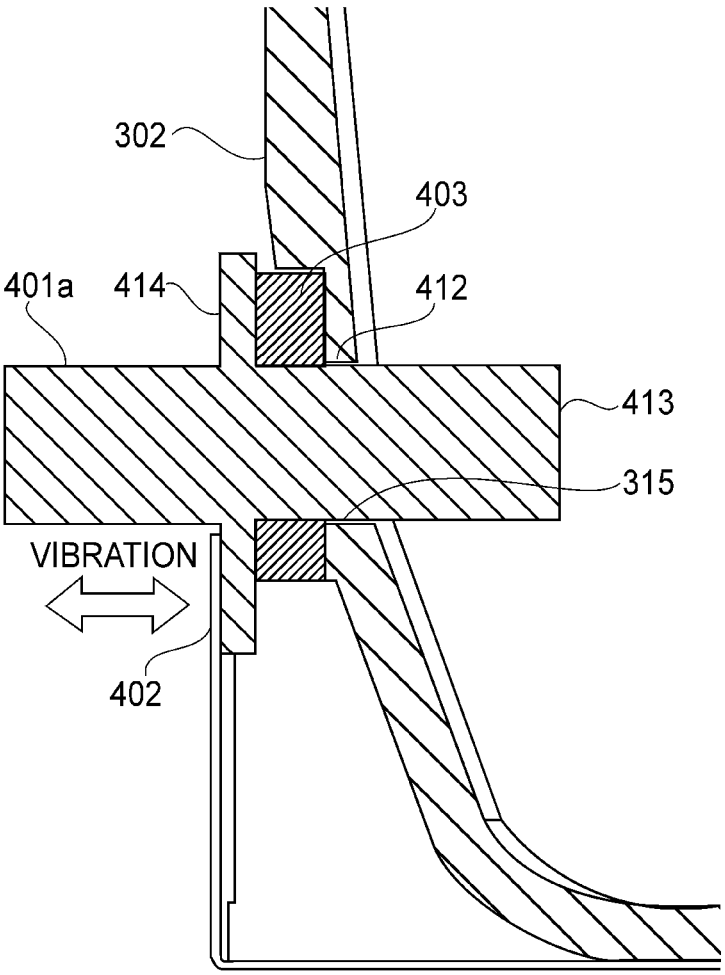
FIG. 7 is an illustration of a mounting structure of the light transmitting member.
Figure 8:
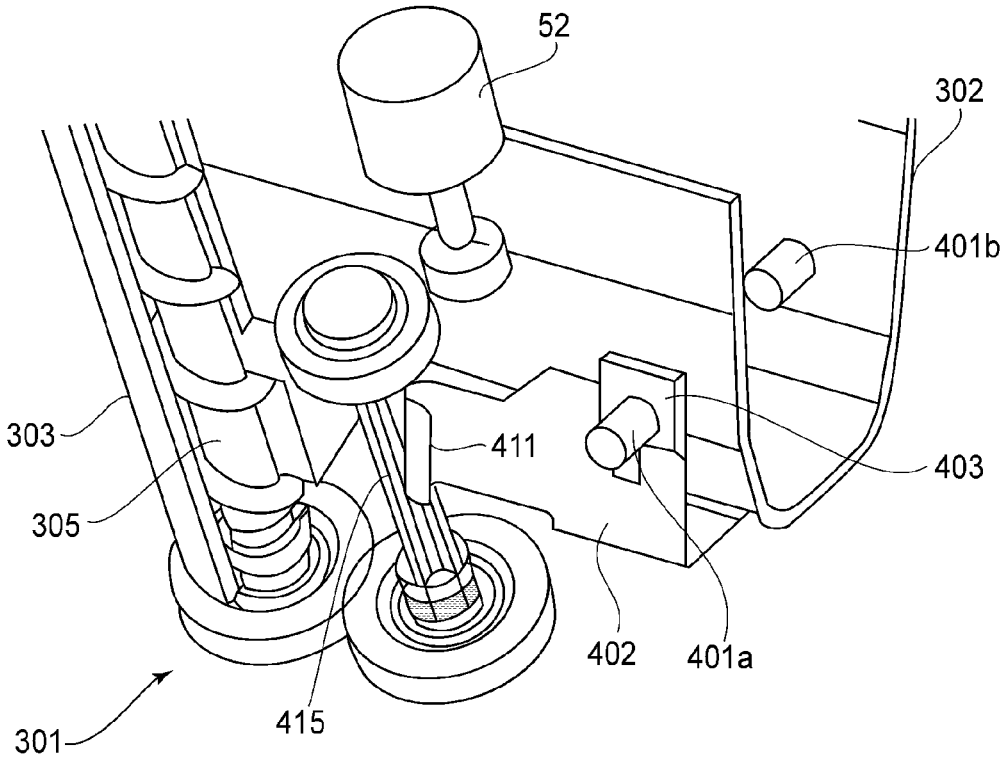
FIG. 8 is an illustration of an arrangement of a vibration transmitting member.

FIG. 6 is an illustration of an arrangement of a light transmitting member. FIG. 7 is an illustration of a mounting structure of the light transmitting member. FIG. 8 is an illustration of an arrangement of a vibration transmitting member. Parts (a) and (b) of FIG. 9 are illustrations of operations of a vibrating generating portion and the vibration transmitting portion, respectively.

As shown in FIG. 6, the opposing side walls of the toner storing portion 302 are provided with the light transmitting members 401*a* and 401*b*. The light transmitting member 401*a* guides the detection light into the toner storing portion 302, and the light transmitting member 401*b* guides the detection light, passing through the toner storing portion 302, to the light receiving element. As described above, when the optical path between the light transmitting members 401*a* and 401*b* is blocked by the toner in the toner storing portion 302, the toner storing portion 302 is judged that there is a sufficient toner therein but is also judged that the amount of the toner at a portion of the toner storing portion 302 where the optical path is not blocked is insufficient.

A mounting structure and vibration (impartment) structure of the light transmitting members 401*a* and 401*b* are the same and therefore these structures will be described with respect to the light transmitting member 401*a* and thus the light transmitting member 401*b* will be omitted from redundant description.

As shown in FIG. 7, the light transmitting member 401*a* is mounted at the toner storing portion 302 so that it can be vibrated relative to the toner storing portion 302 in an optical axis direction, so that run out of the optical axis is not generated by the vibration. That is, the light transmitting member 401*a* is engaged with the side wall of the toner storing portion 302, and movement of the light transmitting member 401*a* in a direction perpendicular to the optical axis direction is prevented by an engaged surface and the light transmitting member 401*a* is held so as to be movable only in the optical axis direction. The light transmitting member 401*a* is disposed to penetrate through the side wall of the toner storing portion 302 and is mounted at the side wall of the toner storing portion 302 via an elastic member 403 which is an example of an elastic material. The elastic member 403 also functions as a seal member in a gap between the side wall of the toner storing portion 302 and the light transmitting member 401*a* (401*b*).

The light transmitting member 401*a* is mounted at an outer surface of the side wall of the toner storing portion 302 via the elastic member 403 of an urethane sponge, so that an end surface 413 of the light transmitting member penetrates through an opening 315 of the side wall of the toner storing portion 302. The elastic member 413 stops up a gap between the opening 315 and the light transmitting member 401*a* to prevent leaking-out of the toner.

A flange portion 414 of the light transmitting member 401*a* is sandwiched between an end portion of a vibrating plate 402 and the elastic member 403 and is urged inward by the vibrating plate 402. The light transmitting member 401*a* is supported by the elastic member 403 and the opening 315 and therefore is vibrated by the vibrating plate 402, so that the light transmitting member 401*a* is efficiently vibrated in the optical axis direction.

As shown in FIG. 8, the vibrating plate 402 which is an example of a vibrating means vibrates the light transmitting members 401*a* and 401*b* to shake off the toner deposited on the end surfaces. A vibration direction of the light transmitting members 401*a* and 401*b* by the vibrating plate 402 is the optical axis direction of the transmitted light of the light transmitting members 401*a* and 401*b* and therefore the optical axis is not readily shaken by the vibration, so that a fluctuation of detected incident light quantity is not readily caused.

On the other hand, vibration timing of the light transmitting members 401*a* and 401*b* is timing when the toner feeding portion 303 feeds the developer toward the developing device 4*a*. An idle gear shaft 415 which is an example of a vibration generating portion is driven by a motor which is an example of a driving motor to generate vibration at the vibrating plate 402. The vibrating plate 402 which is an example of a vibration transmitting portion transmits the vibration generated at the vibration generating portion to vibrate the light transmitting members 401*a* and 401*b*. For this reason, electric power is saved compared with that when the light transmitting members 401*a* and 401*b* are always vibrated, so that a time period in which the end surfaces vibration-contact the toner is minimized.

Specifically, the vibrating plate 402 contacts the light transmitting member 401*a*, so that the light transmitting member 401*a* is also vibrated by the vibration of the vibrating plate 402. By vibrating the light transmitting member 401*a*, the toner fixed on the light transmitting member 401*a* is shaken off in a state in which there is no toner in the toner storing portion 302, so that it becomes possible to an erroneous detection such that the toner is judged as being present even when the toner is absent.

The vibrating plate 402 is formed by bending a metal plate material with a high elastic modulus to pull out one end portion in a beam shape, so that a vibration receiving portion 411 is formed. The vibration receiving portion 411 follows a projection/recess structure formed on the idle gear shaft 415 for transmitting an output of the motor 52 to the screw 305, thus vibrating the vibrating plate 402 with the rotation of the idle gear shaft 415.

As shown in (a) of FIG. 9, the vibrating plate 402 is a U-like metal plate member such that its central portion is mounted on a bottom wall of the toner storing portion 302 and its both end portions are erected along the side walls of the toner storing portion 302. The vibrating plate 402 is constituted by bending a stainless plate into the U-like shape so as to generate the vibration in the optical axis direction, and its central portion is mounted to the bottom of the toner storing portion 302 at a point by a screw. The vibrating plate 402 vibrates its both end portions like a turning fork, thus vibrating the light transmitting members 401*a* and 401*b* in the optical axis direction.

As shown in (b) of FIG. 9, the vibration generating portion causes a part of the vibrating plate 402 to press-contact a projection formed on the idle gear shaft 415 which is an example of a driving shaft for transmitting the rotation of the motor 52 to the toner feeding portion 303. The vibrating plate 402 which is an example of the metal plate member includes a portion, which is elastically bending-deformable with respect to the vibration direction by press-contacting the projection, between a portion to be vibrated by press-contacting the projection with a cross-shaped cross section of the idle gear shaft 415 and a portion for vibrating the light transmitting member 401*a*.

Specifically, the vibration receiving portion 411 of the vibrating plate 402 is subjected to the bending deformation so as to urge the idle gear shaft 415. The idle gear shaft 415 is formed in the cross shape at its cross section and therefore vibrates the vibration receiving portion 411 by displacing the vibration receiving portion 411 four times with one rotation thereof. The idle gear shaft 415 is designed so as to rotate at a rotational speed of 7 turns per second and thereof the vibration is imparted 28 times per second. A leaf spring portion of the vibrating plate 402 between the vibration receiving portion 411 and the light transmitting member 401*a* exhibits a type of a filtering function, so that an unnecessary amplitude such that the optical axis is shaken and a frequency component for preventing the vibration (impartment) are prevented from transmitting to the light transmitting member 401*a* side.

With the rotation of the idle gear shaft 415, the light transmitting members 401*a* and 401*b* are vibrated and therefore the drive of the screw 305 and the vibration of the light transmitting members 401*a* and 401*b* are synchronized. For this reason, when the toner surface (level) in the toner storing portion 302 is lowered by feeding the toner to the developing device 4*a* side by the toner feeding portion 303, the light transmitting members 401*a* and 401*b* are vibrated in a state in which the members are exposed from the toner and therefore the toner can be efficiently shaken off from the end surfaces.

Further, a vibration source for the vibrating plate 402 and a driving source for the screw 305 are the same motor 52 and therefore there is no need to add a driving source dedicated to the vibration of the vibrating plate 402, so that it is possible to contribute to downsizing and cost reduction of the toner supply apparatus 301.

In the toner supply apparatus 301 in Embodiment 1, the toner is shake off from the end surfaces of the light transmitting members 401*a* and 401*b* with timing of the toner feeding to the developing device 4*a*. For this reason, the toner does not remain on the end surfaces in a fixed state, so that accuracy of detection of the toner amount through the light transmitting members 401*a* and 401*b* can be stabilized.

The toner at the end surfaces is shaken off by vibrating the light transmitting members 401*a* and 401*b* and therefore the cleaning member (210: FIG. 5) becomes unnecessary, so that there is no need to provide the cleaning member (210: FIG. 5).

There is no generation of the toner agglomeration caused by the friction, between the toner and the cleaning member 210, at the end surfaces of the light transmitting members 401*a* and 401*b* and therefore there is no lowering of an image quality of an output image due to participation of the toner agglomeration in the development.

There is no friction with the cleaning member 210 and therefore there is no occurrence of abrasion and frictional damage of the end surfaces of the light transmitting members 401*a* and 401*b*. For this reason, the toner detection accuracy is stabilized over a long term, so that it is possible to provide a developing device and an image forming apparatus, which have a long life time, in which a toner supply apparatus with a long lifetime is mounted.

Embodiment 2

The use of the constitution for shaking off the toner deposited on the end surfaces by vibrating the light transmitting members is not limited to the toner supply apparatus for supplying the toner to the developing device. The constitution can also be carried out in an optical sensor for detecting the developer level in the developing device. The constitution can also be carried out not only in the developing device using the two-component developer but also in the developing device using a one-component developer.

For example, as shown in FIG. 2, the use of detection of the level of the developer circulated in the developing container 41 by providing (mounting) light transmitting members 401*a* and 401*b*, similar to those in Embodiment 1 in the same manner as in Embodiment 1, at the side walls of the developing container 41 of the developing device 4*a* would be considered.

In this case, the storing portion is the developing container 41 for storing and circulating the two-component developer. The light transmitting members 401*a* and 401*b* have the end surfaces located in the developing container 41, so that the optical path is blocked by the developer stored in the developing container 41. Then, the light transmitted through the light transmitting members 401*a* and 401*b* is detected to control the developer level in the developing container 41.

The light transmitting members 401*a* and 401*b* are mounted at the developing container 41 via the elastic member 403 so as to permit vibration and are provided with a dedicated vibrator, and then are vibrated with only timing when the developer level is detected to shake off the toner at the end surfaces.

In the developer supply apparatus according to the present invention, the developer deposited on at least one of the end surfaces of the light transmitting members, i.e., the light exit surface and the light incident surface, is shaken off by the vibration by the vibrating plate. Therefore, without rubbing the exit surface and incident surface of the detection light with separate members, the developer deposited on the surfaces is effectively removed, so that the developer level in the storing portion can be detected with accuracy over a long term.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 044185/2011 filed Mar. 1, 2011, which is hereby incorporated by reference.

What is claimed is:

1. A developer supply apparatus comprising:

a buffer portion for storing a developer supplied from a developer container;

a pair of light transmitting members, which permit light transmission, for detecting the developer in said buffer portion;

a vibrating device for vibrating said pair of light transmitting members in an optical axis direction; and a supporting portion for supporting said pair of light transmitting members so that said pair of light transmitting members is movable in the optical axis direction relative to said buffer portion and is prevented from moving in a direction perpendicular to the optical axis direction.

2. A developer supply apparatus according to claim 1, further comprising a feeding device for feeding the developer, stored in said buffer portion, toward a developing device;

wherein vibration timing of said light transmitting members by said vibrating device is timed to when said feeding device feeds the developer toward the developing device.

3. A developer supply apparatus according to claim 1, wherein said pair of light transmitting members is provided by penetrating through a side wall of said buffer portion and is mounted to the side wall of said buffer portion via an elastic member.

4. A developer supply apparatus according to claim 3, wherein said elastic member functions as a seal member of a gap between the side wall of said buffer portion and the light transmitting members.

5. A developer supply apparatus according to claim 1, wherein said supporting portion has an engaging surface engaged with said light transmitting members, and wherein said light transmitting members are prevented from moving in the direction perpendicular to the optical axis direction by the engaging surface.

6. A developer supply apparatus according to claim 1, further comprising an elastic member between said light transmitting members and said buffer portion with respect to the optical axis direction, wherein said vibrating device includes a leaf spring member for urging said light transmitting members toward said elastic member and for vibrating said light transmitting members.

7. A developer supply apparatus according to claim 6, wherein said light transmitting members include a cylindrical member provided with a flange portion partly projected in a radial direction, and wherein said leaf spring member is urged against a side surface of the flange portion perpendicular the optical axis direction.

8. A developer supply apparatus comprising:

a buffer portion for storing a developer supplied from a developer container;

a pair of light transmitting members, which permit light transmission, for detecting the developer in said buffer portion;

a vibrating device for vibrating said pair of light transmitting members in an optical axis direction; and a feeding device for feeding the developer, stored in said buffer portion, toward a developing device, wherein said vibrating device includes a vibration generating portion for generating vibration by being driven by a driving motor for said feeding device and a vibration transmitting portion for transmitting the vibration generated by the vibration generating portion thereby to vibrate said light transmitting members.

9. A developer supply apparatus according to claim 8, wherein said supporting portion has an engaging surface engaged with said light transmitting members, and wherein said light transmitting members are prevented from moving in the direction perpendicular to the optical axis direction by the engaging surface.

10. A developer supply apparatus according to claim 8, further comprising an elastic member between said light transmitting members and said buffer portion with respect to the optical axis direction, wherein said vibrating device includes a leaf spring member for urging said light transmitting members toward said elastic member and for vibrating said light transmitting members.

11. A developer supply apparatus according to claim 10, wherein said light transmitting members include a cylindrical member provided with a flange portion partly projected in a radial direction, and wherein said leaf spring member is urged against a side surface of the flange portion perpendicular the optical axis direction.

* * * * *